US011697188B2

(12) United States Patent
Lang

(10) Patent No.: US 11,697,188 B2
(45) Date of Patent: Jul. 11, 2023

(54) METHOD FOR CLAMPING OF WORKPIECES AS WELL AS EMBOSSING DEVICE AND CLAMPING DEVICE

(71) Applicant: Lang Technik GmbH, Holzmaden (DE)

(72) Inventor: Guenter Lang, Wernau (DE)

(73) Assignee: LANG TECHNIK GMBH, Holzmaden (DE)

( * ) Notice: Subject to any disclaimer, the term of this patent is extended or adjusted under 35 U.S.C. 154(b) by 0 days.

(21) Appl. No.: 17/103,472

(22) Filed: Nov. 24, 2020

(65) Prior Publication Data

US 2021/0162567 A1 Jun. 3, 2021

(30) Foreign Application Priority Data

Nov. 28, 2019 (DE) ..... 10 2019 132 276.6

(51) Int. Cl.
*B25B 5/02* (2006.01)

(52) U.S. Cl.
CPC ..... *B25B 5/02* (2013.01)

(58) Field of Classification Search
CPC ..... B25B 1/2405; B25B 1/2452; B25B 1/241; B25B 3/00; B25B 5/00; B25B 5/02
USPC ..... 29/559; 269/43, 45, 156, 242, 246, 271
See application file for complete search history.

(56) References Cited

U.S. PATENT DOCUMENTS 2,838,971 A * 6/1958 Shekter ..... B25B 1/2452 269/268
3,229,401 A 1/1966 Sobran
4,655,267 A 4/1987 Smith, Jr. et al.
6,530,567 B1 * 3/2003 Lang ..... B25B 1/2405 269/257
9,296,090 B2 3/2016 Bronzino

FOREIGN PATENT DOCUMENTS

| | | |
|---|---|---|
| DE | 1294264 | 4/1969 |
| DE | 3707200 | 10/1987 |
| DE | 102009052334 A1 | 7/2010 |
| DE | 102016224517 A1 | 6/2018 |
| EP | 1071542 B1 | 1/2001 |
| EP | 2724817 B1 | 6/2015 |
| WO | 9952678 A1 | 10/1999 |

OTHER PUBLICATIONS

European Search Report for EP Application No. 20 20 7248. Search Report dated Oct. 21, 2020.
European Search Report for EP Application No. 20 20 7248, dated Aug. 13, 2021.

* cited by examiner

*Primary Examiner* — Lee D Wilson
*Assistant Examiner* — Alberto Saenz
(74) *Attorney, Agent, or Firm* — Cantor Colburn LLP

(57) ABSTRACT

A method for clamping a workpiece that is first provided with depressions, wherein these depressions are, arranged in one row or a field having a grid distance of 3 mm. The grid distance is thereby the center distance of the depressions, the depth of which is preferably less than the length of the depressions measured in direction of the row of the depressions. The distances between the depressions preferably correspond approximately to the length of the depressions. The grid distance of 2.5 mm to 3 mm has proven to be an optimum for a wide range of usable workpieces and materials.

20 Claims, 11 Drawing Sheets

METHOD FOR CLAMPING OF WORKPIECES AS WELL AS EMBOSSING DEVICE AND CLAMPING DEVICE

CROSS REFERENCE TO RELATED APPLICATIONS

This application claims priority under 35 U.S.C. § 119 to the following German Patent Application No. DE 10 2019 132 276.6, filed on Nov. 28, 2019, the entire contents of which are incorporated herein by reference thereto.

TECHNICAL FIELD

The invention refers to a method for clamping of workpieces consisting of ductile material, as well as an embossing device for use in this method as well as a clamping device also for use in this method.

BACKGROUND

For processing or machining of workpieces in machine tools, particularly for chip-creating machining, the workpieces have to be clamped and held in suitable clamping units. The clamping must be carried out in a manner such that during the machining processes that have to be carried out on the workpiece, also larger forces can be supported without movement of the workpiece in the clamping device or without releasing of the workpiece therefrom. On the other hand, the workpiece must be accessible as far as possible, in order to be able to carry out as many machining processes on the workpiece as possible with one single clamping setting.

For this EP 1 071 542 B1 proposes a method for clamping of workpieces in which regularly spaced depressions are provided on a workpiece in a preparing process step, wherein these depressions do only serve as coupling elements during clamping with a respective clamping device, but are without any function apart therefrom. After this preparing process step the workpieces are placed in chucks that have abutment surfaces at their clamping jaws for friction-fit clamping and that have form-fit elements for form-fit positioning and securing of position that are complimentary to the depressions of the workpiece. Thus the workpiece is clamped in a form-fit as well as friction-fit manner. This clamping method has proved itself in general.

Further a clamping method is known from DE 10 2009 052 334 A1 in which the workpiece is provided with a clamping structure in the proximity of its base surface. Two grooves provided at the flanks of the workpiece form part thereof in which corresponding bar-like projections of two clamping jaws of a chuck engage. The grooves are, for example, introduced by means of a milling process and provide a form-fit connection between the clamping jaws and the workpiece. The wall remaining at the workpiece and limiting the groove must be resistant against bending and breaking, which requires a certain minimum wall thickness of the groove wall. This determines the space requirement of the clamping structure.

When configuring clamping systems, it has to be expected that users desire to machine a range of different workpieces from different materials without being limited to one certain type of workpiece and material. This has to be considered when clamping systems are configured. On one hand the clamping device must reliably hold the workpieces, also if they are subject to high machining forces, wherein on the other hand damaging the workpieces by means of the clamping device has to be avoided, such as unallowed deformations or excavations.

BRIEF SUMMARY

Starting therefrom it is the object of the invention to provide a clamping method with which a wide range of workpieces consisting of different materials can be clamped, wherein the space required by the clamping device on the workpiece shall be as small as possible.

The clamping method according to the invention is based on that in a preparing process step deformations are provided in a defined grid on the workpieces to be clamped, e.g. in the shape of a row of regularly distanced depressions. These depressions (or other deformations) serve as positioning and coupling elements during clamping in a respective clamping device, whereby they do not fulfill any other function on the workpiece apart therefrom. For clamping of the workpieces the clamping jaws comprise clamping surfaces for the friction-fit holding of the workpiece. In addition, the clamping jaws are provided with form-fit elements, preferably at the abutment surfaces that serve to form-fit positioning and securing of the workpiece position. The workpiece is thus clamped in a combined friction-fit and form-fit manner.

According to the invention, the deformations provided on the workpiece are arranged with a center distance of 2.5 mm to 3.5 mm from each other. It has been shown that by means of such a grid an optimum in terms of the holding force and the area required on the workpiece for holding can be obtained. Local stress peaks in the workpiece are reduced to an amount supportable for most materials and a uniform holding force transmission between the clamping jaws and the workpiece is obtained. Excavations, crack formations on the workpiece or other workpiece damages are avoided. A grid dimension of 3 mm (center distance) forms an optimum of the ratio of reachable holding force to required surface area that applies for most of the ductile materials such as plastics, particularly plastically deformable plastics, aluminum, aluminum alloys, as well as other metal alloys and metals.

The depressions are preferably arranged in a row that extends along the bottom edge of the workpiece next to the base surface of the workpiece. Preferably the row is a straight row. The depressions can, however, also be arranged in two or more rows, preferably arranged parallel to each other. The depressions of two rows can be arranged adjacent to one another in pairs or can be alternatively offset from each other. In at least one of the two (or more) rows, preferably in all of the rows, the grid distance is defined to a value in a range from 2.5 mm to 3.5 mm, preferably 3 mm.

Preferably the deformations that have to be provided on the workpiece are depressions that are introduced in the workpiece by plastic deformation by means of an embossing device. Each depression can be created by material displacement by means of an embossing tooth. The depressions are preferably arranged in a straight row and with constant distances to each other. Between the depressions non-depressed or also slightly elevated areas are formed that separate the individual depressions from each other.

The depressions have preferably a rectangular cross-section with rounded corners, wherein the cross-section decreases toward the bottom of the depression. The rectangular depressions have preferably a length in the direction of the row in which they are arranged that is at least as long as the length of the areas between two adjacent depressions respectively that is measured in the same direction.

The material displacement that occurs during creation of the depressions, leads to a flow of the material of the workpiece, whereby below the depression and around the depression a zone of hardened material can be created. Particularly when using metals and metal alloys, this zone can have an increased strength so that it is particularly suitable for support and distribution of forces in the workpiece.

Preferably a distance between the embossing tool and the workpiece is left open between two adjacent embossing teeth in which displaced material can enter. The workpiece surface that is smooth prior to the embossing, e.g. cylindrical or planar, thus obtains the desired deformations, e.g. depressions, during the preparing process step. Thereby wavy or elevated deformations of the workpiece surface can be created between these depressions, due to material displacement. The workpiece surface resulting therefrom that does not only contain depressions for reception of the form-fit elements of the clamping jaw, but in addition is curved multiple times. In other words the formerly smooth workpiece surface can comprise certain regular deformations, particularly in the areas between the depressions or around these depressions after the formation of the depressions.

In the inventive method the clamping surfaces of the clamping jaws are preferably brought in complete contact with the workpiece surface during clamping of the workpiece. In other words the clamping surface of the clamping jaw is pressed with high force on the workpiece surface that was potentially slightly deformed in the preparing working step. In doing so, the workpiece surface can be smoothed in that material displaced out of the workpiece surface is (elastically or plastically) deformed again until—in the ideal condition—the planar clamping surface abuts against the workpiece completely in a two-dimensional manner. This can be combined with a slighter additional plastic deformation of the workpiece, whereby the workpiece is held in the clamping device between the clamping jaws particularly reliably.

The inventive embossing device serves for carrying out of the inventive method. At least one embossing die is part of the embossing device, wherein the embossing die comprises an embossing structure that defines a grid, wherein the grid dimension is in a range of 2.5 mm to 3.5 mm. The embossing die can be a linearly movable die, a roller die or the like. The embossing device comprises a counter support for reception of the workpiece, wherein the counter support is arranged opposite the embossing die. The counter support itself can be configured as embossing die, such that on the workpiece on two opposite sides facing away from each other, the desired positioning and coupling elements can be provided in one single working step.

For embossing the one embossing die or the more embossing dies are pressed against the workpiece, preferably by means of a force generating device. The force generating device is preferably configured to have the embossing die or embossing dies to act on the workpiece with a predefined force. In doing so, the embossing depth is defined by the ductility of the workpiece material. However, in any case damage of the workpiece, due to an excessive force acting on the workpiece, is avoided.

The depressions are created by means of the embossing device preferably while measuring the penetration depth of the embossing teeth. In doing so, it can be ensured that the depressions reach a desired depth during the embossing process, but do not exceed a maximum depth. Mechanical means for limiting the penetration depth, as e.g. abutment teeth provided at the embossing jaws (between the embossing teeth) are not provided. Rather a free space is respectively formed between two embossing teeth, the limitation of which does not get into contact with the workpiece. The penetration depth of the embossing teeth is preferably defined to an amount that is deeper than the tooth height of the holding teeth. In doing so, an uncontrolled workpiece deformation during clamping as well as an excessive wear of the holding teeth is avoided.

The embossing device comprises preferably multiple embossing teeth, the center distance of which corresponds to the grid dimension. Preferably each embossing tooth is provided with at least one, preferably with two or more flanks curved in a concave manner such that the flank angle continuously decreases with the progressive penetration of the embossing tooth during embossing at the penetration location of the workpiece. In this manner similar penetration depths are provided also in different ductile materials such that the workpieces embossed in this manner fit on the clamping device in any case. A small variability of the penetration depth of the embossing teeth can be achieved in case of a large variability of the ductility of the different workpiece materials. In doing so, it is guaranteed that the form-fit elements of the clamping device fit in the depressions provided on the workpiece independent from the used material of the workpiece. This applies at least to a wide range of workpiece materials.

As mentioned, at least slightly different penetration depths of the embossing teeth and thus slightly different cross-sections of the depressions are obtained in different ductile materials. Due to the control or regulation of the embossing force, however, it can be achieved that the embossed depressions always have a depth that is deeper than the tooth height of the holding teeth.

The holding teeth of the clamping jaws are so small that they fit into the smallest depressions that have to be expected in any case. For this reason they can engage with a slightly lateral play in the depressions, if the workpiece is made of a very ductile material and the depressions are rather large. Due to the pressing force that the clamping surfaces of the clamping jaws effect on the workpiece surface and thus on the surrounding area of each depression, however, the depressions can be slightly narrowed again such that the holding teeth finally engage in the depressions without play.

The embossing teeth of the embossing die limit between each other an interstice in which workpiece material can flow during embossing. The interstice preferably comprises limitation or boundary that follows the contour of a cylinder. In addition, the embossing teeth are preferably formed on a bar projection of the embossing die. This ensures that during embossing no planar surface outside the embossing teeth get in contact with the workpiece surface. In doing so, the individual depressions can be surrounded by a more or less large ring-shaped elevation depending on the workpiece ductility. The workpiece surface can freely deform outside of the depressions. This is achieved in that the embossing force acts only and exclusively between the embossing teeth and the workpiece.

The inventive clamping device comprises at least one, preferably multiple clamping jaws, the workpiece clamping surface of which is provided with form-fit elements that are arranged in the predefined grid of the depressions, i.e. comprising a uniform center distance in a range from 2.5 mm to 3.5 mm, preferably 3 mm. The form-fit elements are preferably teeth, the shape of which is similar to the shape of the embossing teeth, wherein the holding teeth are preferably smaller than the embossing teeth. For this reason the dimension and shape of a depression in materials with low ductility can correspond to the shape and dimension of a holding tooth. In high ductile materials the depressions created by the embossing teeth can be indeed also wider and deeper such that the holding teeth are first engaging the depressions with some play. In order to compensate potentially different embossing depth, the holding teeth (or other form-fit elements) are preferably less high than the depressions embossed in the workpiece are deep. When clamping the workpiece, however, a part of the material displaced by the embossing tooth can flow back and finally surround the holding teeth of the clamping device completely and preferably without any gaps. In addition, a two-dimensional contact between the workpiece clamping surface and the workpiece can be achieved. In doing so, the form-fit and the friction-fit are maximized.

Embossing jaws with embossing teeth of a different dimension can be provided for different workpiece materials. In addition or as an alternative, different embossing forces can be used for different workpiece materials. For this the embossing device can be configured such that the embossing force can be adjusted accordingly. In addition or as an alternative, a measurement or monitoring device can be provided that is configured for measuring or monitoring the penetration depth of the embossing teeth in the workpiece. The embossing device can be configured such that it terminates the embossing process, if the desired depth of the depressions is reached. In all presented embodiments the depth of the depressions is preferably in a range of 0.2 mm to 2 mm. Preferably the depth of the embossed depression is larger than the height of the holding tooth by an amount in the range of 0.02 mm to 0.05 mm.

BRIEF DESCRIPTION OF THE FIGURES

Further details and advantages of the inventive clamping system are apparent from the drawings and the claims. The drawings show:

DETAILED DESCRIPTION

Figure 1:
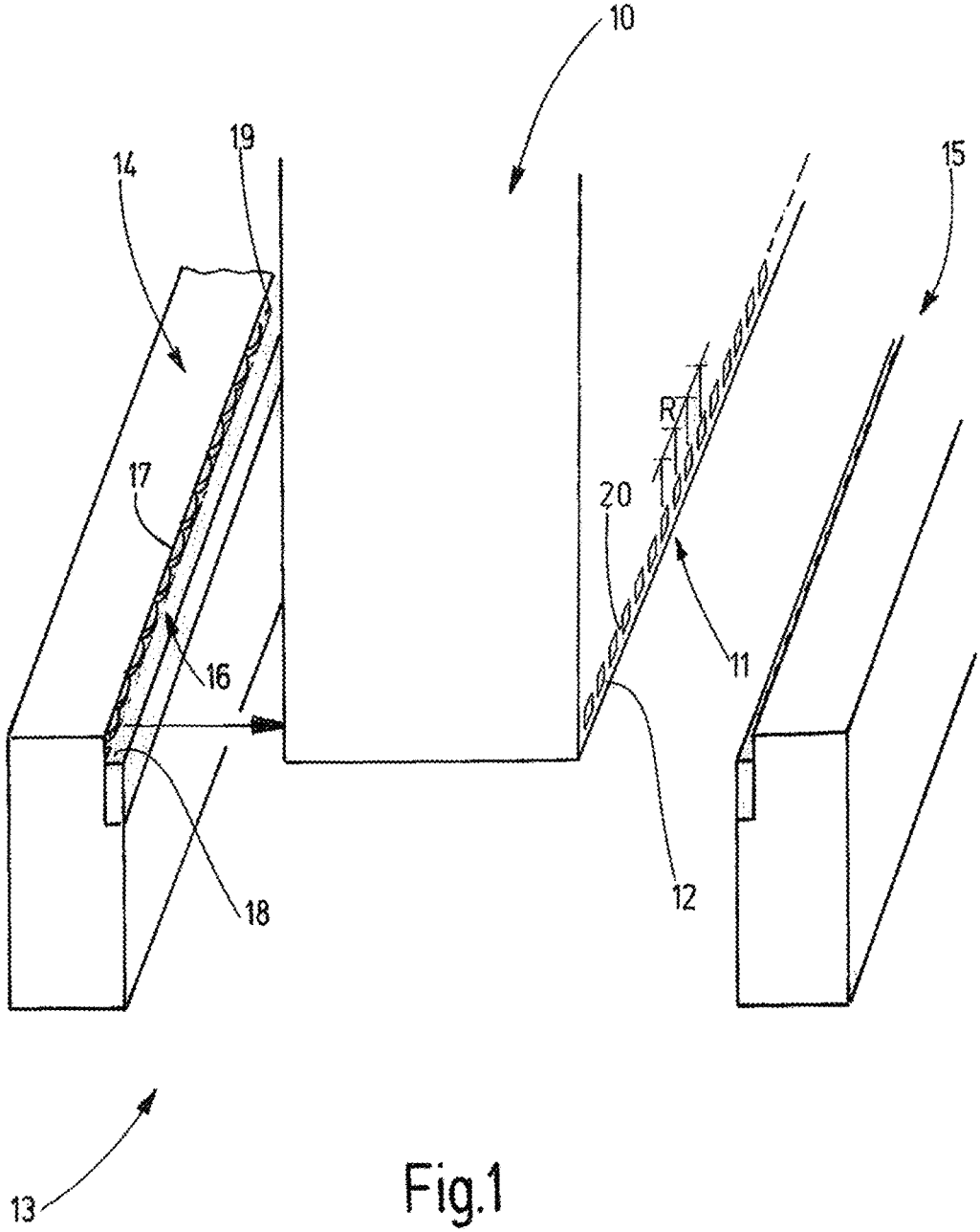
FIG. 1 a prepared workpiece during the clamping in an inventive clamping device, FIG. 2 an embossing die forming part of an embossing device in a perspective overview illustration, FIG. 3 the embossing die during an embossing process in its relation to the workpiece in a schematic illustration, FIG. 4 an embossing tooth during embossing and during penetration into the workpiece, FIG. 5 the workpiece after execution of the preparing embossing process in a schematic perspective illustration, FIG. 6 the workpiece and an embossing die in a slightly modified embodiment after the embossing process in a schematic illustration, FIG. 7 the workpiece and a clamping jaw during clamping of the workpiece in a sectional schematic illustration, FIG. 8 a relation between grid dimension and scaled holding force in form of a diagram, FIG. 9 an embossing device in a schematic top view, FIG. 10 a modified embodiment of an embossing die and an assigned workpiece after the embossing process in a schematic side view, FIGS. 11 and 12 further embodiments of the inventive clamping system and assigned workpieces.

FIG. 1 illustrates a method for clamping a workpiece 10. In the exemplarily and schematically illustrated workpiece 10 deformations 11, e.g. in the form of a row of depressions 12, have been provided in a preparing process step. They serve as position and coupling elements during clamping in a respective clamping device 13. The clamping device 13 comprises at least one movable clamping jaw 14 and a counter bearing 15 assigned thereto that can also be configured as clamping jaw in a mirror-symmetrical manner compared with the clamping jaw 14. Also other counter bearings, e.g. clamping jaws having smooth clamping surfaces can be used.

The subsequent description of the clamping jaw 14 applies for the present and all further embodiments, for the counter support 15 configured as clamping jaw or additional clamping jaws and counter supports accordingly.

The clamping jaw 14 comprises a row of form-fit elements 16 that can have the shape of holding teeth 17 that fit with the depressions 12 in terms of shape, position and dimension. The holding teeth 17 are, e.g. arranged in a straight row that is arranged in a distance to a support surface 18 formed on the clamping jaw 14. The holding teeth can, however, also be arranged in another pattern, e.g. in a zigzag row or in two or more rows. The preferably planar support surface 18 is arranged orthogonal to a clamping surface 19 from which the holding teeth 17 project. The clamping surface 19 is preferably a planar surface. Preferably the holding teeth 17 are configured uniformly.

The depressions 12 as well as the holding teeth 17 are arranged in a corresponding grid R that is symbolically marked on the workpiece 10 in FIG. 1. The grid R defines the center distances of the depressions 12 as well as the center distances of the holding teeth 17 to a uniform value within a range between 2.5 mm and 3.5 mm. Preferably the center distance of the holding teeth 17 as well as the depressions 12 is defined to 3 mm in the grid R.

During clamping of workpiece 10 between the clamping jaws 14, 15 the holding teeth 17 engage in the depressions 12 and the clamping surface 19 gets in contact with the workpiece surface 20 surrounding the depressions 12. Thereby the clamping surface 19 applies a pressure force on the workpiece surface 20. Concurrently the holding teeth 17 are positioned in the depressions 12 without play. In doing so, the workpiece 10 is clamped in a friction-fit and form-fit manner. Due to the low grid dimension of preferably 3 mm, a quasi-continuous form-fit holding of the workpiece 10 with low local force peaks is obtained thereby. Concurrently due to the latching of the holding teeth 17 in the depressions 12, the workpiece position parallel to the clamping jaws 14, 15 is defined.

Figure 2:
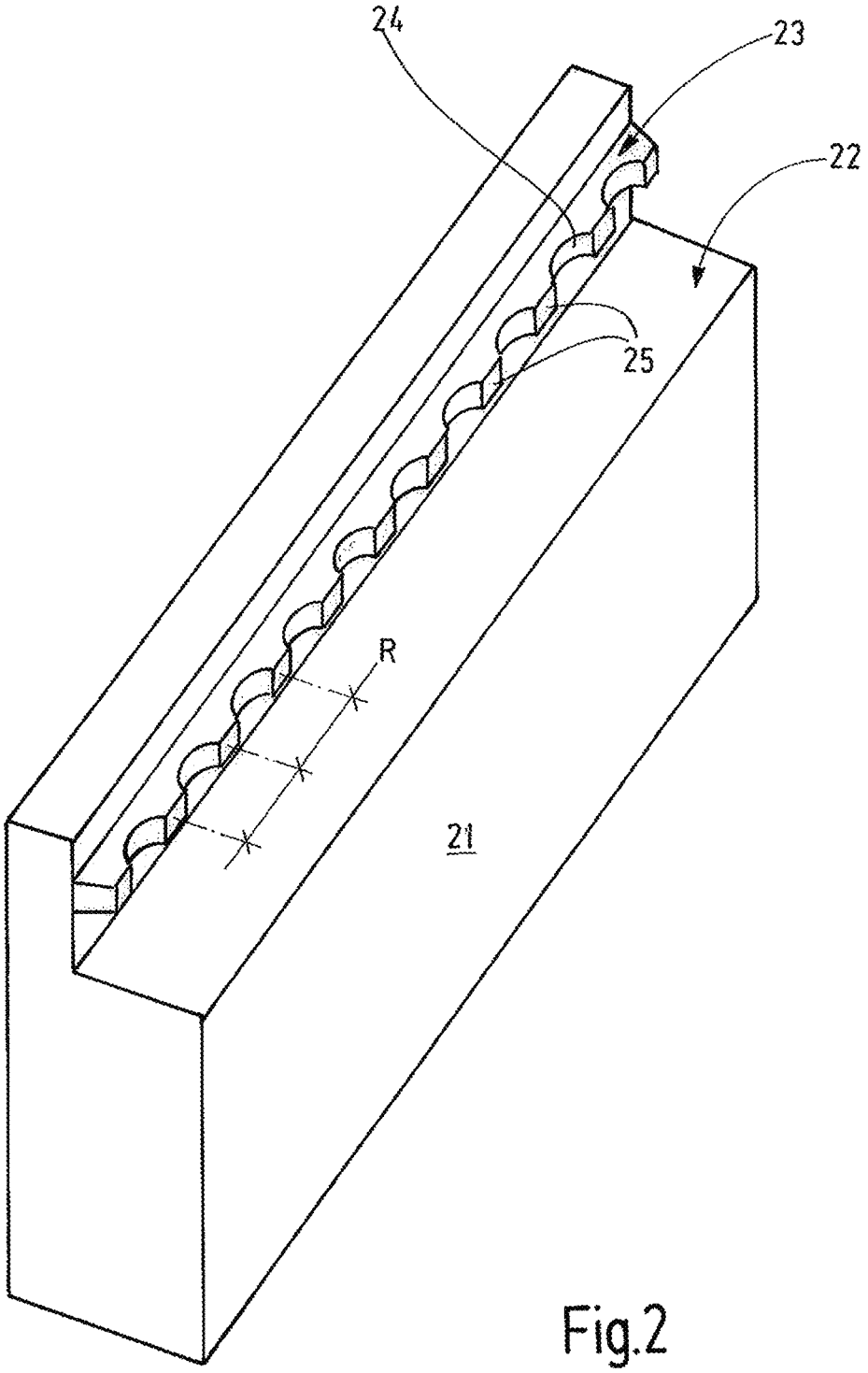

FIG. 2 illustrates a part of the tool for creation of the depressions 12 on the workpiece 10. The depressions 12 are thereby not part of the desired workpiece geometry, but only serve to clamp the workpiece 10. They are provided in an area of the workpiece 10 in which no machining processes are required in the selected setting.

Figure 9:
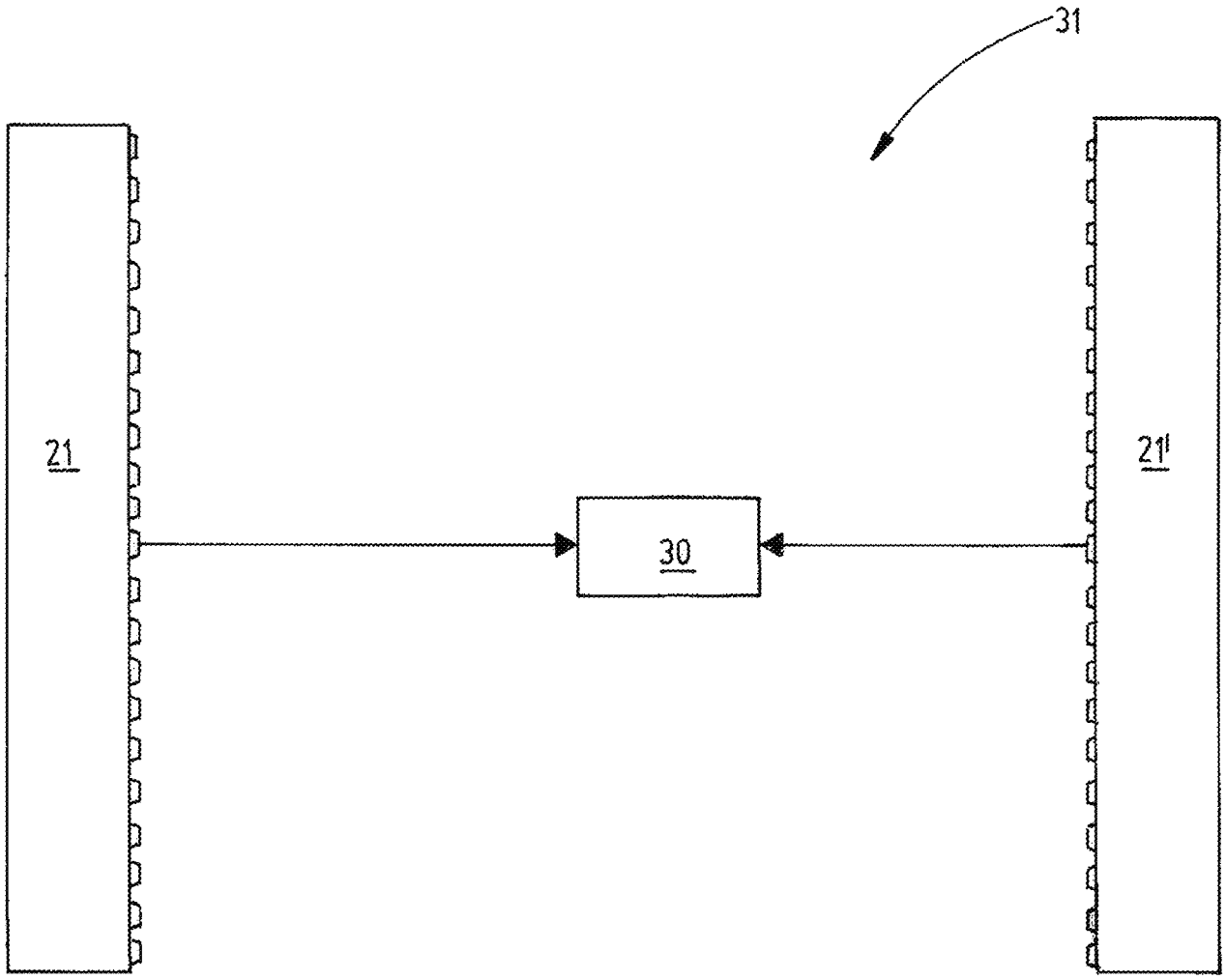

FIG. 9 illustrates an embossing device 31 for creation of depressions 12 at the workpiece 10. The embossing device 31 preferably comprises two embossing dies 21, 21' that can be moved and clamped toward each other by means of a force creation device 30. For this the force creation device is connected with the two embossing dies 21, 21' and is configured to apply a controlled force on a workpiece 10 held between the two embossing dies 21, 21'. The two embossing dies 21, 21' are preferably configured identically and are arranged mirror-symmetrically with regard to each other.

The embossing die 21 illustrated in FIG. 2 comprises a support surface 22 on which the workpiece 10 can be placed before executing an embossing process. The support surface 22 can be a planar surface or also a surface that is disrupted multiple times. It is also possible to omit such a support surface 22.

A bar 23 is configured on the embossing die 21 parallel to the support surface 22. The bar 23 is preferably provided with curved or rounded cavities 24. These cavities 24 have preferably a shape corresponding to a cylindrical surface section in each case and limit the embossing teeth 25 between each other, the embossing teeth 25 being arranged in the grid R. In other words the center distances are defined in the preferred grid of 2.5 mm to 3.5 mm and have, for example, a uniform amount of 3 mm.

Apart therefrom, the bar 23 can have parallel flanks or can be wedge-shaped, i.e. extending toward the tips of the embossing teeth 25 in a wedge-shaped manner. In addition the embossing teeth can also be configured in a curved or rounded manner on these flanks.

Figure 3:
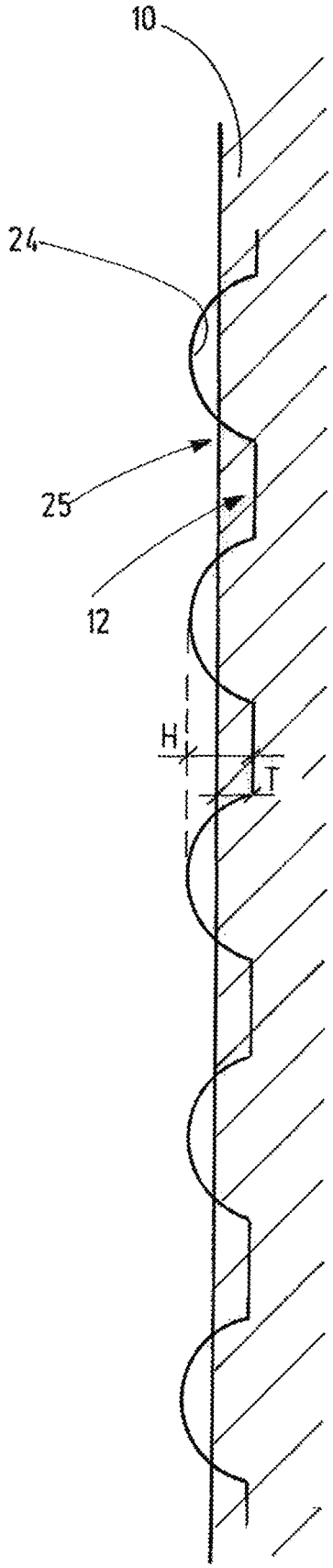

FIG. 3 illustrates the ratio of the dimension of the embossing teeth to the depressions 12 created in the workpiece 10 for complimentary clarity. As apparent, the embossing teeth are pushed in the material of the workpiece 10 only partly during the embossing process, i.e. their respective height H (compare FIG. 3) is longer than the depth T of the created depressions 12. The height H of the embossing teeth 25 can be measured originating from a dashed illustrated virtual connection line of the deepest positions of the depressions 12 shown in FIG. 3 up to the tooth tip and can have an amount of, e.g. 3 mm. The depth T of the depressions 12 then correspond to the penetration depth of the teeth.

During an embossing process the embossing dies 21 are preferably moved toward each other in a force-actuated manner, wherein the embossing process is executed preferably in a force-controlled manner, however, at least in a force-limited manner. This means that depth T results from a cooperation of the material ductility of workpiece 10 and the applied embossing force. In doing so, and contrary to distance-controlled embossing processes that have a defined penetration depth, damage of workpiece 10 is avoided. In addition or as an alternative, the penetration depth of the embossing teeth can be measured during the embossing process. The penetration depth is the distance that the embossing jaws travel subsequent to the first contact of the workpiece with the faces of the embossing teeth. The embossing device can be configured to terminate the embossing process as soon as the desired penetration depth is reached and thus the desired depth of the depression is achieved. The depth T of the depression 12 is preferably at least slightly longer than the height of holding teeth 17. The difference can be, e.g. in a range from 0.02 mm to 0.05 mm and can also have a higher or less amount if applicable.

Figure 4:
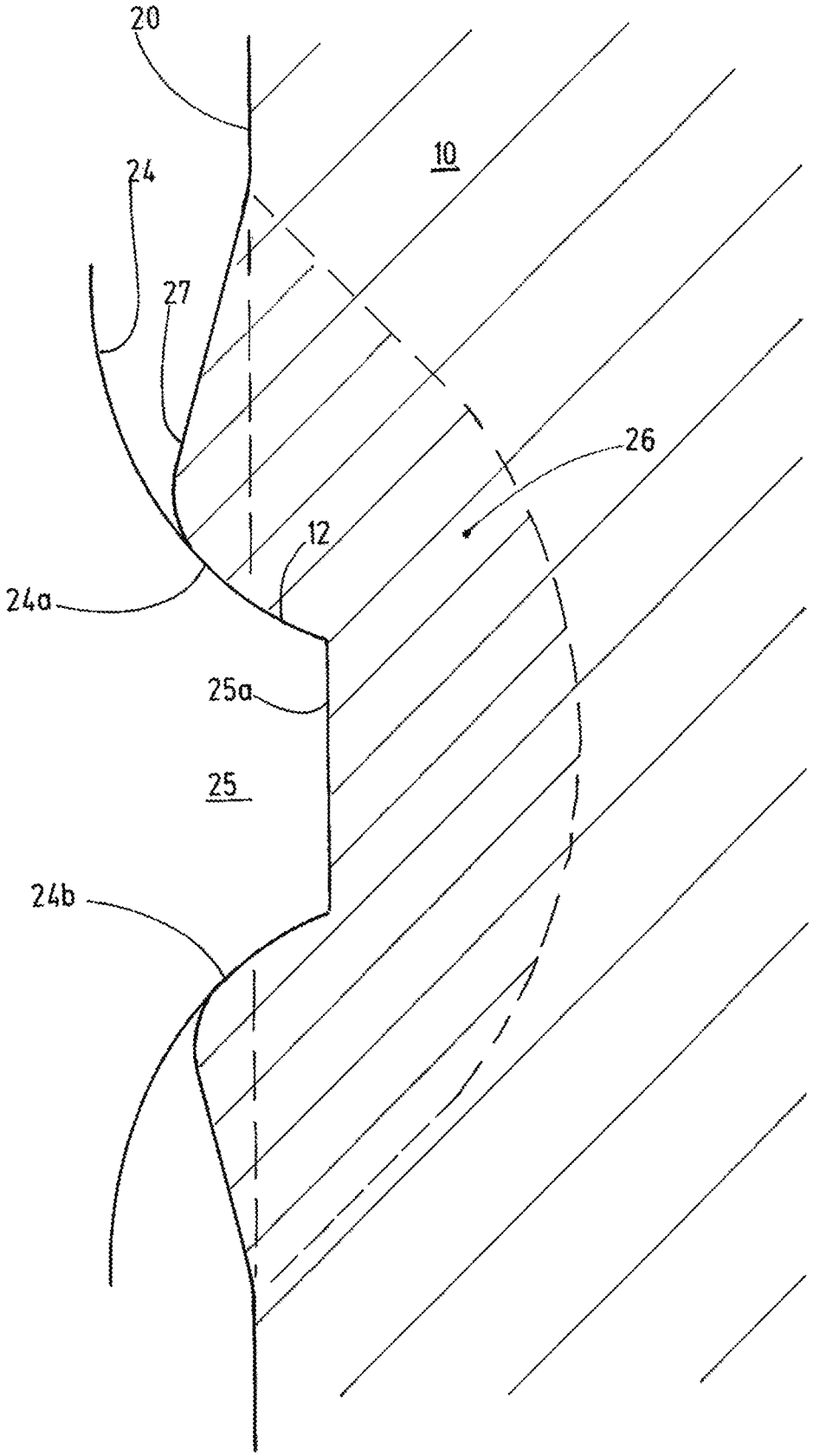
Figure 5:
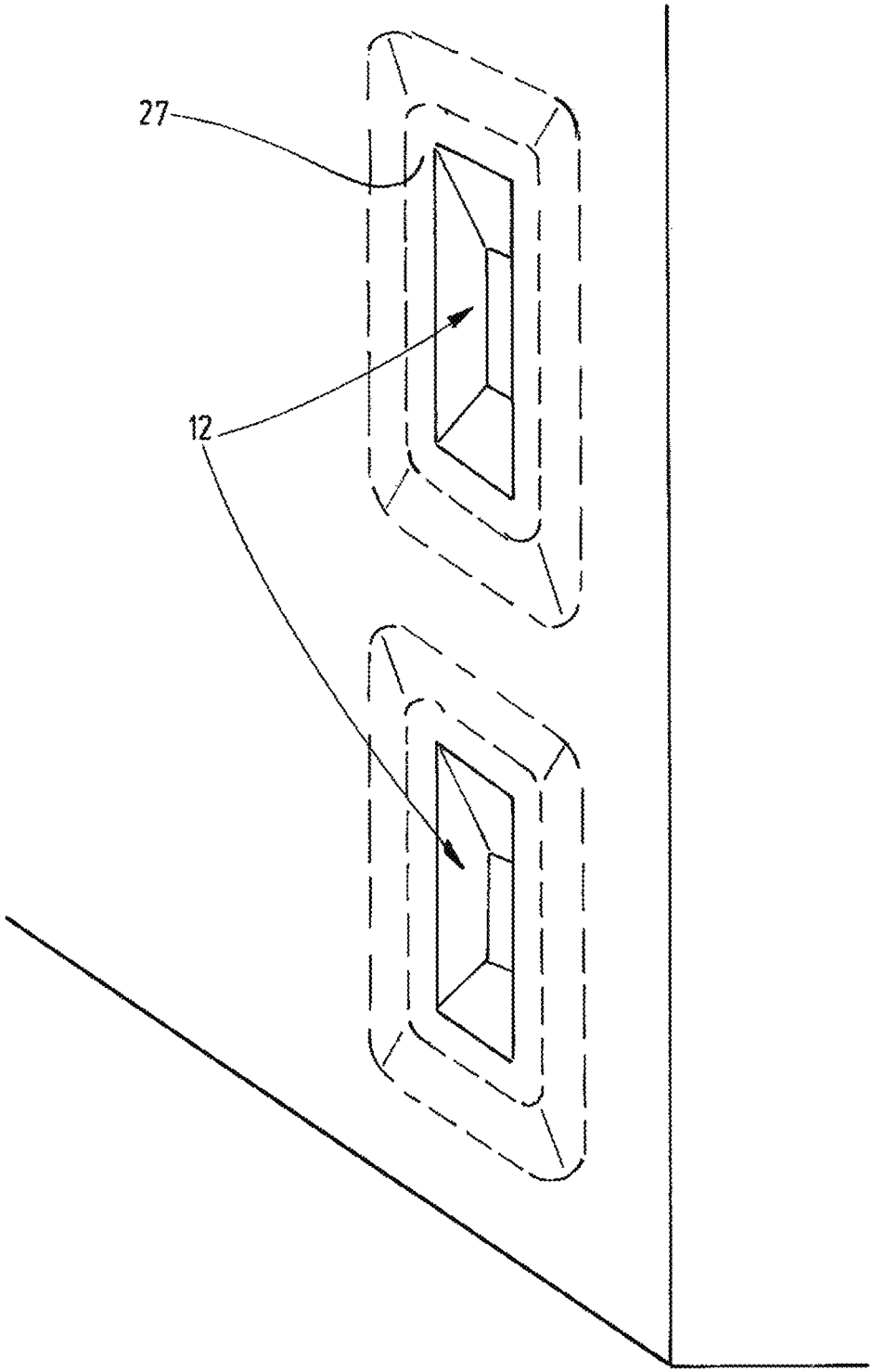

FIG. 4 illustrates the embossing process with a well-flowable and thus ductile material, as e.g. ductile aluminum. The embossing tooth 25 penetrates in the workpiece surface 20 locally, wherein the material of the workpiece 10 is displaced and deformed. An influenced zone 26 is created in which the material of the workpiece 10 is compacted and can also be hardened, due to the deformation. In addition, a non-planar deformation of the workpiece surface 20 can be formed around the created depression 12, e.g. in the form of a wall-like bulge or elevation 27 or in another slight lifting of the workpiece surface 20 counter to the penetration direction of the embossing tooth 25. This is in slightly exaggerated illustration also shown in FIGS. 5 and 6.

As also apparent from FIG. 4, the cross-section of the embossing tooth increases originating from its face 25*a*. Due to the preferably present curvature of its flanks 24*a*, 24*b*, the penetration resistance of the embossing tooth increases disproportionally with increasing penetration depth.

Figure 6:
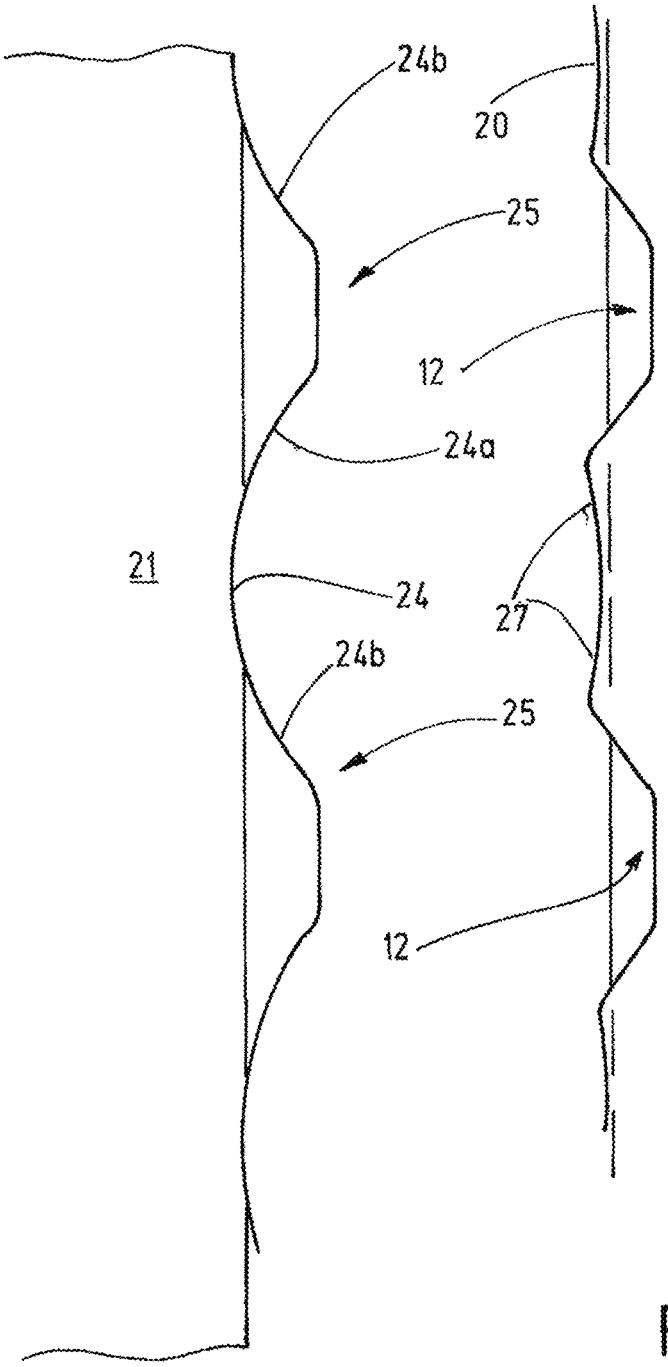

As shown in FIG. 6, the workpiece surface 20 has multiple curves, particularly between the depressions 12 after the creation of the depressions 12—also, if the workpiece surface 20 was planar prior thereto—i.e. it bulges around different centers of curvature and thus deviates from the planar shape as well as from other simple geometric shapes, such as for example a cylindrical shape.

The embossing teeth 25 have preferably two or also four flanks 24*a*, 24*b* that are curved in a concave manner, as particularly shown in FIGS. 2 and 6, such that the resistance of each embossing tooth 25 during the embossing process increases non-linearly with increasing penetration depth. For this reason depressions are obtained during the embossing of materials with different ductility having a depth T that is in any case sufficient in order to receive the holding teeth 17. The penetration depth is still deeper in more ductile material. The variation of the depth T is, however, substantially lower than the variability of the ductility of the different materials that can be used. In addition, the penetration depth can be monitored during embossing and can be feed-back controlled to a desired value. Workpieces 10 can consist, e.g. of aluminum, aluminum alloys, different other metals and metal alloys or plastic. By means of the curvature of the surface 24 it can be achieved that also in softer materials a complete penetration of the embossing tooth 25 in the workpiece 10 is not to be expected.

Figure 7:
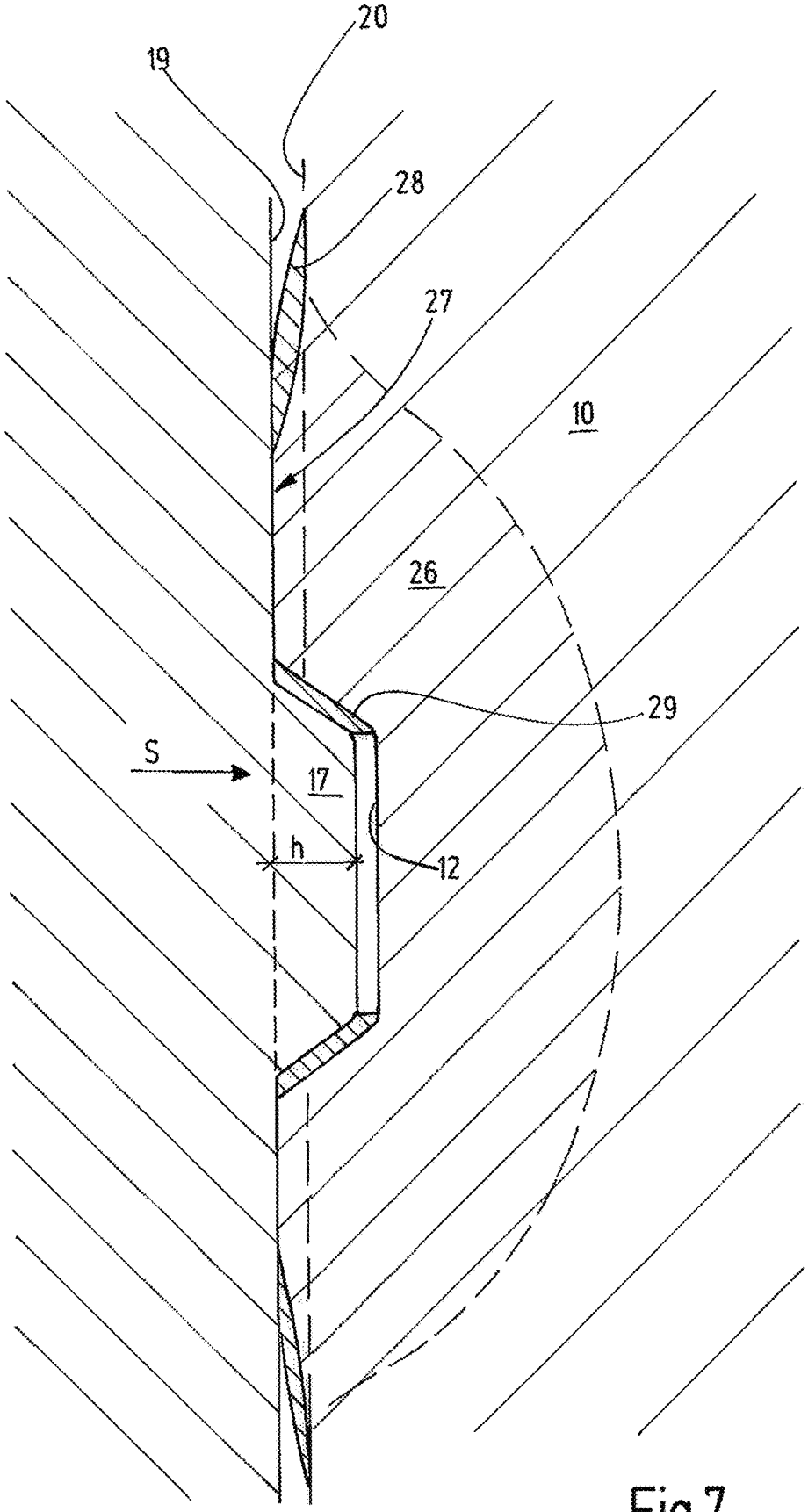

As already mentioned, the clamping surface 19 and the workpiece surface 20 are brought into contact during clamping while the holding teeth 17 engage the depressions 12. As apparent from FIG. 7, preferably the height h of a holding tooth measured in clamping direction S is smaller than the depth T of the depression 12. During the clamping process the wall-like elevation 27 is at least partly planed such that material of the workpiece, particularly zone 26 is further deformed and tightly huddles around the holding tooth 17. Thereby the material may flow again, such that additional deformation areas 28, 29 result that are illustrated with hatches in FIG. 7. Thus, a large section of the clamping surface 19, preferably the whole clamping surface 19 and the outer surface (24*a*, 24*b*) of the holding teeth 17 is used as holding force transmitting surface. The material of the workpiece 10 is in abutment against the flanks with pretention and potentially also against the faces of the holding teeth 17. Preferably the depth of the depression 12 is so deep, such that the face of the holding tooth 17 does not contact the bottom of the depression 12, if the workpiece 10 is clamped (compare FIG. 7).

Figure 8:
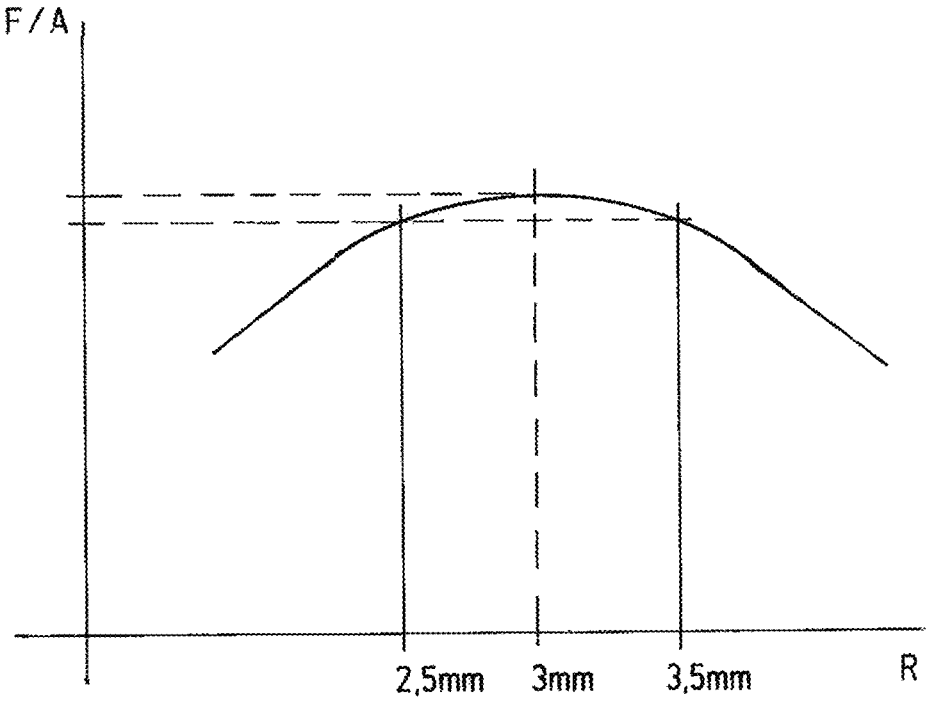

Due to the predefined grid distance of preferably 3 mm, it is achieved that the influenced zones 26 of the different embossing teeth 25 abut or overlap in the workpiece 10. In doing so, a quasi-continuous clamping of the workpiece 10 is allowed. Tests thereby show that longer as well as shorter grid distances lead to reduced workpiece holding forces. FIG. 8 illustrates this in a diagram. The vertical axis (ordinate) shows the ratio of achievable holding force F to the provided clamping surface area A. In order to obtain comparable curves for different materials, the force F is scaled on the maximum holding force without holding teeth.

The horizontal axis (abscissa) shows a grid dimension of the grid R. The grid dimension is a center distance of the embossing teeth 25 and concurrently the center distance of the depressions 12 as well as the center distance of the holding teeth 17. It has been shown that the maximum achievable holding force F related to the area A reaches a maximum with a grid dimension of 3 mm, wherein in the range from 2.5 mm to 3.5 mm still good holding force values can be achieved. The decrease with regard to the maximum holding force has an amount in this area of mostly less than 30%, frequently less than 10%. This applies to nearly all of the at least somehow ductile and thus embossable materials practically used.

Thereby the holding force F is a force that is effective orthogonal to the support surface 18 and thus tends to pull the workpiece 10 that is clamped between the clamping jaws 14, 15 out of the clamping jaws 14, 15 (vertical to the top in FIG. 1).

Surprisingly it has shown that the grid distance of 2.5 mm to 3.5 mm is an optimum for a wide range of workpieces and materials such that no determination on specific materials and workpiece geometries is necessary for the presented clamping system. A universal clamping system can be offered having a wide application in practice.

Figure 10:
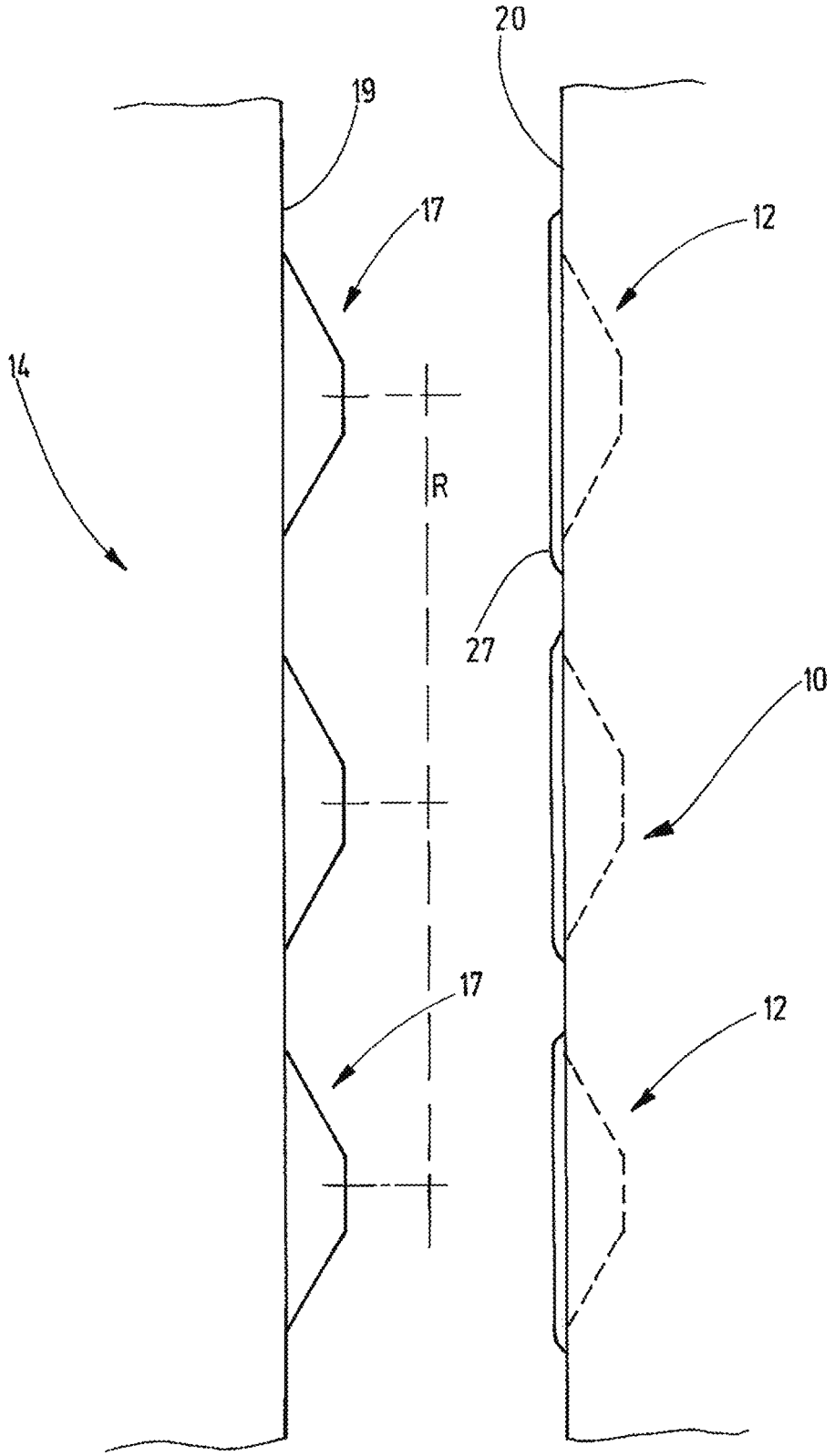

As illustrated in FIG. 10, modifications are possible. For example, the embossing teeth and accordingly also the holding teeth 17 can have substantially planar flanks, wherein apart therefrom the above description applies accordingly.

Figure 11:
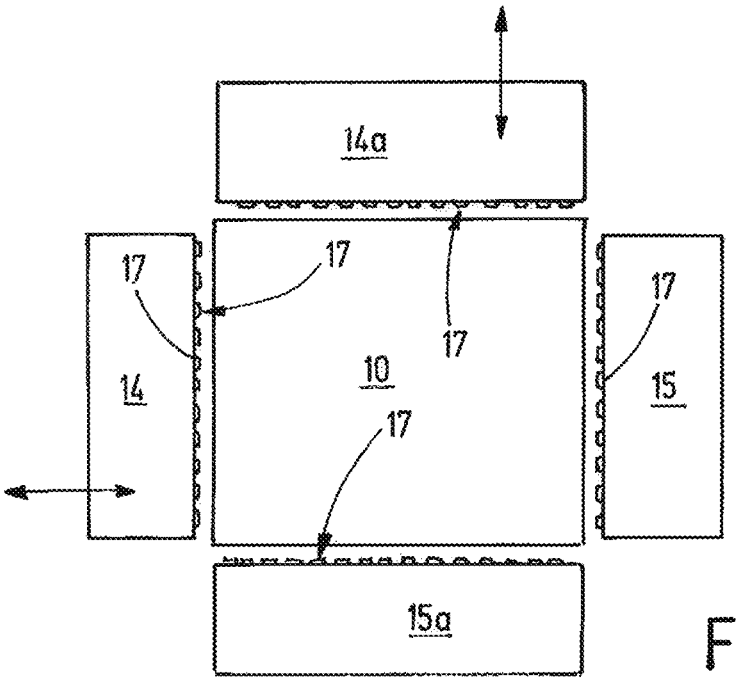

In addition, FIG. 11 illustrates another modification of the invention as described above, wherein the workpiece 10 is held between four jaws 14, 15, 14*a*, 15*a* that comprise holding teeth 17 in each case and for which the description of the clamping jaw 14 applies accordingly. Clamping jaws 14, 15, 14*a*, 15*a* arranged opposite each other are moved by clamping drives toward each other or away from each other and can, therefore, clamp the workpiece 10 at four sides.

Figure 12:
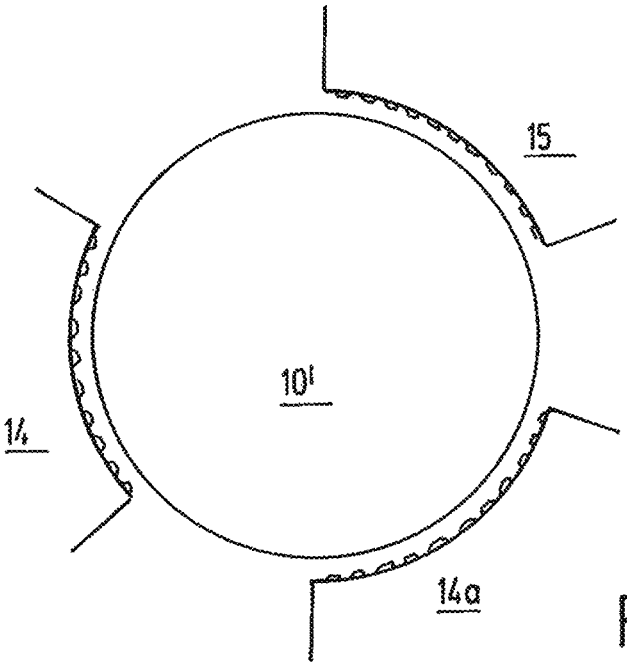

FIG. 12 shows the clamping of a workpiece 10' at the cylindrical section thereof by means of corresponding cylinder section shaped adapted clamping jaws 14, 14*a*, 15, wherein the workpiece 10' is provided with the necessary depressions prior to clamping in a preparing working step, preferably by embossing, as also the case in all other embodiments of the invention.

In the inventive clamping method a workpiece 10 is first provided with depressions 12, wherein these depressions are, for example, arranged in one row or in a field having a grid dimension with preferably 3 mm grid distance. The grid dimension is thereby the center distance of the depressions 12. The depth T of the depressions 12 is preferably less than the length of the depressions 12 measured in the direction of the row of the depressions 12. The distances between the depressions 12 preferably correspond approximately to the length of the depressions 12.

Preferably these depressions 12 are formed with embossing tools that comprise embossing teeth 25 with rounded flanks 24*a*, 24*b*. Preferably the flanks 24*a*, 24*b* are rounded in a concave manner.

The embossing process is preferably carried out such that elevated areas 27 are formed between the depressions 12 that first get into contact with the planar clamping surface 19 of clamping jaws 14, 15 during clamping of the workpiece 10 between the clamping jaws 14, 15. A deformation of these elevated areas 27 during the clamping process increasing the holding force.

The grid distance of 2.5 mm to 3.0 mm has proven to be an optimum for a wide range of usable workpieces and materials.

LIST OF REFERENCE SIGNS

10, 10' workpiece
11 deformations
12 depressions
13 clamping device
14 clamping jaws
15 counter support
16 form-fit elements
17 holding teeth
18 support surface
19 clamping surface
R grid
20 workpiece surface
21 embossing die
22 support surface
23 bar
24 cavities
24*a*, *b* flanks of embossing tooth 25
25 embossing teeth
25*a* face of embossing tooth 25
H height of embossing teeth 25
T depth of cavities 12
26 influenced zone
27 wall-like elevation
R grid
S clamping device
h height of holding tooth 17
F holding force
A area of clamping surface 20
28, 29 deformation areas
30 force creation device
31 embossing device

What is claimed is:

1. A method for clamping of a workpiece, in which in a preparing process step deformations in a defined grid are provided on the workpiece that exclusively serve as positioning and coupling elements during clamping in a corresponding clamping device, that apart therefrom do not have any additional function, in which the workpieces is clamped in a combined friction-fit and form-fit manner with clamping jaws that have clamping surfaces for friction-fit holding of the workpiece and that have form-fit elements for form-fit positioning and securing a position of the workpiece that match with the deformations, wherein the deformations are arranged in the defined grid with a center distance in a range of 2.5 mm to 3.5 mm relative to each other.

2. The method according to claim 1, wherein the deformations are depressions that are introduced in the workpiece by plastic deformation by an embossing device, in that each depression is created by one embossing tooth of the embossing device due to material displacement.

3. The method according to claim 2, wherein between adjacent embossing teeth of the embossing device a distance is maintained to the workpiece in order to allow an elevated deformation of a workpiece surface during embossing.

4. The method according to claim 2, wherein the depressions are formed on a workpiece surface that is curved multiple times between the depressions.

5. The method according to claim 4, wherein planar clamping surfaces provided at the clamping jaws are brought into two-dimensional contact with the workpiece surface during clamping of the workpiece.

6. The method according to claim 5, wherein the workpiece surface is brought into a planar shape during clamping of the workpiece.

7. An embossing device for carrying out the method according to claim 1, having at least one embossing die that comprises an embossing structure defining a grid having a grid distance in a range of 2.5 mm to 3.0 mm.

8. The embossing device according to claim 7, wherein the embossing device comprises a counter support for the workpiece, wherein the counter support is arranged opposite the embossing die.

9. The embossing device according to claim 8, wherein the counter support is configured as additional embossing die.

10. The embossing device according to claim 9, wherein a force creation device is arranged between the counter support and the embossing die.

11. The embossing device according to claim 10, wherein the embossing die comprises at least two embossing teeth, a center distance of which corresponds to the grid distance.

12. The embossing device according to claim 11, wherein each embossing tooth comprises at least one flank that is curved in a concave manner.

13. The embossing device according to claim 12, wherein between the at least two embossing teeth an interstice is defined limited by a cylindrical contour.

14. The embossing device according to any of the claim 13, wherein the at least two embossing teeth are formed on a bar projection.

15. The embossing device according to claim 8, wherein a force creation device is arranged between the counter support and the embossing die.

16. The embossing device according to claim 7, wherein the embossing die comprises at least two embossing teeth, a center distance of which corresponds to the grid distance.

17. The embossing device according to claim 16, wherein each embossing tooth comprises at least one flank that is curved in a concave manner.

18. The embossing device according to claim 16, wherein between the at least two embossing teeth an interstice is defined limited by a cylindrical contour.

19. The embossing device according to claim 16, wherein the at least two embossing teeth are formed on a bar projection.

20. A clamping device for clamping of a workpiece according to the method of claim 1, the clamping device having at least one embossing die that comprises an embossing structure defining a grid having a grid distance in a range of 2.5 mm to 3.0 mm, wherein the deformations serve as positioning and coupling elements that have been created with an embossing device, the embossing device having a workpiece clamping surface on which form-fit elements are arranged in a predefined grid.

* * * * *